US007519213B2

(12) United States Patent
Klock et al.

(10) Patent No.: US 7,519,213 B2
(45) Date of Patent: Apr. 14, 2009

(54) OPTICAL DOUBLE FEED DETECTION

(75) Inventors: Hansjorg Klock, Rubigen (CH); Peter Dilwyn Evans, Hampshire (GB); Joelle Egli, Hunibach (CH)

(73) Assignee: De La Rue International, Ltd., Hampshire (GB)

( * ) Notice: Subject to any disclaimer, the term of this patent is extended or adjusted under 35 U.S.C. 154(b) by 666 days.

(21) Appl. No.: 10/530,287

(22) PCT Filed: Mar. 2, 2004

(86) PCT No.: PCT/GB2004/000875

§ 371 (c)(1),
(2), (4) Date: May 19, 2005

(87) PCT Pub. No.: WO2004/080865

PCT Pub. Date: Sep. 23, 2004

(65) Prior Publication Data

US 2006/0115138 A1 Jun. 1, 2006

(30) Foreign Application Priority Data

Mar. 12, 2003 (EP) ..... 03251488

(51) Int. Cl.
*G06K 9/00* (2006.01)

(52) U.S. Cl. ..... 382/135; 250/559.11; 382/322

(58) Field of Classification Search ..... 382/135; 209/194; 194/206

See application file for complete search history.

(56) References Cited

U.S. PATENT DOCUMENTS

| | | | | |
|---|---|---|---|---|
| 4,255,057 | A | 3/1981 | Williams | |
| 6,040,584 | A * | 3/2000 | Liu et al. | 250/559.11 |
| 6,040,923 | A | 3/2000 | Takashimizu et al. | |
| 6,101,266 | A * | 8/2000 | Laskowski et al. | 382/135 |
| 2001/0035603 | A1 | 11/2001 | Graves et al. | |

FOREIGN PATENT DOCUMENTS

| | | |
|---|---|---|
| JP | A 57-184041 | 11/1982 |

* cited by examiner

*Primary Examiner*—Matthew C Bella
*Assistant Examiner*—Claire Wang
(74) *Attorney, Agent, or Firm*—Oliff & Berridge, PLC

(57) ABSTRACT

In an apparatus for processing banknotes or other sheet-like objects, the banknotes are conveyed along a transport path, thereby passing sensor means. A transmission and a reflection image of the banknote are captured by illuminating the banknotes and measuring the transmittive and reflective light intensity of light with a high resolution. Based on these images, a validation of the banknotes is carried out. After the validation, a double feed detection is performed by evaluating the transmission and the reflection intensities for a predefined set of test spots with a two-dimensional evaluation. If it is decided on double feed, the banknotes are rejected. Otherwise the banknotes are accepted and further processed. Because of the additional dimension in the evaluation compared with known double detection methods, the invention enables a more robust double note detection also in cases with different degrees of soiling of the banknotes.

19 Claims, 3 Drawing Sheets

OPTICAL DOUBLE FEED DETECTION

Figure 1:
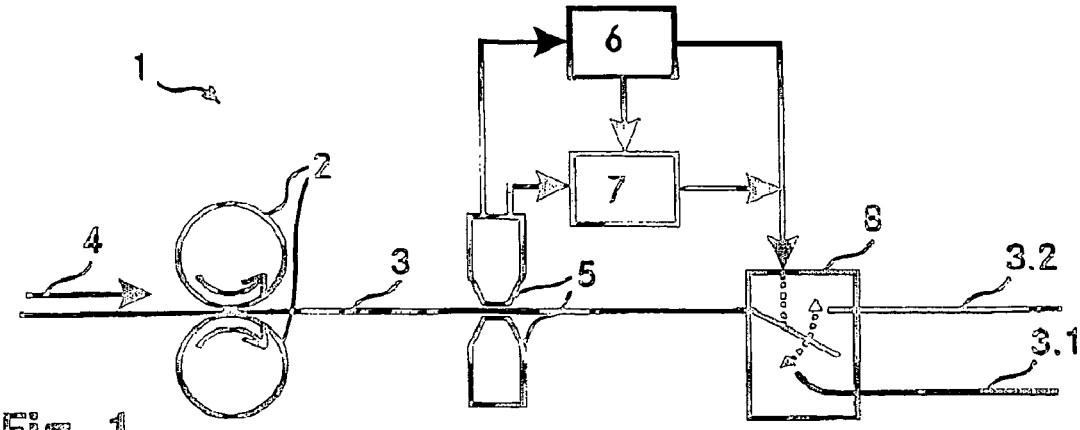

The invention relates to a method for optically detecting a double feed in an apparatus for processing one or more types of sheet-like objects, particularly banknotes, where said objects are conveyed along a transport path in a moving direction. The invention further relates to a corresponding apparatus.

In the processing of sheet-like objects where these objects are fed into an apparatus sequentially one by one and conveyed along a transport path, problems may occur due to a double feed of the objects. In a double feed two or more sheets are fed into the apparatus at the same time where one sheet can partially or completely overlap another sheet. In such cases, it may be significantly more difficult or even impossible to correctly process the objects. In, for example, an apparatus for processing banknotes or other securities, it may be very difficult to correctly count, identify and/or authenticate the banknotes when a double feed occurs. The processing may even produce wrong results, if a double feed remains unnoticed. Therefore, double feed detection is an important feature in the processing of sheet-like objects.

Double feed detection is typically carried out with one or more sensor devices that are arranged on the transport path within the processing apparatus. Further sensor devices may also be included in the apparatus for determining other characteristics of the sheet-like objects. Classical optical doubles detectors are based on a mechanical roller system equipped with a position-sensing device, However, contact establishing sensor devices sometimes cause jams in the transport system, when the sheets are conveyed along the transport path. In order to reduce such jams, contact-free sensor devices have been introduced.

For example, U.S. Pat. No. 6,101,266 A discloses a device for identifying and validating banknotes. The device comprises three sensors, where each sensor has four differently coloured LED's (light emitting diodes) for illumination of a banknote and two photo cells, one on the same side of the banknote as the LED's for sensing light reflected from the banknote and one on the opposite side of the banknote for sensing light transmitted through the banknote. A plurality of correlation values is determined and then some or all of these multiple correlation values are combined to form a single overall correlation value. The identification decision or the double feed decision then are made based on this single overall correlation value.

Although the disclosed arrangement can be used for double note detection, it is dedicated for banknote identification/authentication. The results in detecting double notes are not always satisfactory.

U.S. Pat. No. 4,255,057 discloses an apparatus for determining the quality of currency and for detecting double feed of banknotes. The apparatus comprises a light source which illuminates the banknotes that are transported by roller sets. The reflected and transmitted light is then sensed by a reflection sensor and a transmission sensor respectively. In the evaluation procedure, the amount of transmitted and reflected light of the bill is measured. To improve the inspection of banknotes, it is suggested to compensate the errors due to the light source and the circuit variations by normalizing the absorption measurement to the incident light level. U.S. Pat. No. 4,255,057 uses a simple one-dimensional value, namely the absorbtivity as the basis for the decision, whether the quality of the banknote under test is sufficient or not.

US-A-2001/0035603 discloses a method and an apparatus for detecting double notes. For this purposes, a scanning device contains one or more light sensors for sensing light reflected from the banknote and one or more light sensors for sensing light transmitted through the banknote under test. Fluorescent or incandescent light from one or more light sources is used to illuminate the bill. A reflectance ratio is calculated based on a master reflected light value and the reflected light from the banknote. Then the raw transmitted light value is adjusted by multiplying it with the reflectance ratio and the adjusted transmitted light value is compared to a master transmitted light value to determine a double note condition, Again, a simple evaluation is performed.

JP-A-57184041 discloses a detection device to perceive the multi-feed of paper money. In a detection device, the reflected and transmitted light is sensed by a transmission detection element and by a reflection detection element. The quantity of reflected and transmitted light is then used to calculate the ratio between the two signals. The decision whether a multi-feed is present or not is solely based on this ratio.

It is therefore an object of the invention to create a method and an apparatus for optically detecting a double feed of sheet-like objects pertaining to the technical field initially mentioned, that yields more reliable results in detecting a double feed, particularly a lower number of double notes that are accepted as single notes and a lower number of single notes that are wrongly rejected as doubles.

The solution of the invention regarding a method for optically detecting a double feed is specified by the features of claim 1. According to the invention, the sheet-like objects are illuminated, a transmission image of a specific sheet-like object as well as a reflection image of the specific sheet-like object are produced by measuring the transmission intensities of radiation transmitted through and light reflected from the sheet-like object respectively. Then, a two-dimensional evaluation method is applied, where the first dimension is formed by the transmission intensities and the second dimension is formed by the reflection intensities.

The solution of the invention regarding an apparatus for optically detecting a double feed is specified by the features of claim 9. According to the invention, the apparatus for processing one or more types of banknotes has transport means for conveying the banknotes along a transport path in a moving direction. It further includes a detector for optically detecting a double feed of banknotes that comprises illumination means for illumination of the sheet-like objects, a transmission-type sensor for producing the transmission image of the banknotes and a reflection-type sensor for producing the reflection image. The apparatus further includes an evaluator which is built such that the two-dimensional evaluation can be carried out as explained above.

A preferred application of the invention is double feed detection of banknotes in an apparatus for banknote processing. However, the invention can advantageously be applied in other applications such as the processing of cheques or other securities or any other kind of sheet-like objects such as for example paper sheets. Therefore, the term "banknote", which is used throughout the rest of the description, shall, unless otherwise mentioned, not be considered restrictively but it shall be read to include all these types of sheet-like objects. With respect to the term "light" as used throughout the description, it shall, unless otherwise mentioned, not only include the visible part of the electromagnetic spectrum but any radiation with a wavelength in the electromagnetic spectrum.

By applying a two-dimensional-evaluation method, the double feed decision can be based on a two-dimensional decision boundary instead on the one-dimensional higher/lower comparison of a single correlation value with a certain threshold. Moreover, the double feed decision is based on images (the reflection image as well as the transmission image) of the sheet-like objects instead of using just some spot measurements to decide on double feed. The resulting double feed decisions are much more accurate compared with the prior art.

Soil on the banknote not only affects the intensity of the light transmitted through the banknote but also the intensity of the light reflected from the banknote. In general, higher the degree of soiling is, the lower are the light intensities for transmission and reflection. A double feed decision based on both properties therefore decreases not only the number of over-critical (falsely rejected singles) but as well the under-critical (falsely accepted doubles) decisions.

This method for detecting double feed of banknotes can be applied in any kind of banknote processing apparatus. It could for example be applied in an apparatus, where the banknotes are fed manually one by one and processed one after the other. But preferably, this method is applied in a banknote processing apparatus, where the banknotes are sequentially and automatically fed into the apparatus and conveyed along a transport path in a moving direction and with a defined speed.

In a further preferred embodiment of the invention, first a position and an angle of the banknote with respect to the transport path are determined in a position analysis step when a specific banknote is conveyed along the transport path. Then, in a second step, the required images are produced by conveying the banknote past a multitude of sensor cells arranged in at least one line being perpendicular to the moving direction. Each line of sensor cells forms a sensor array positioned on the transport path. During the time interval, when the banknote passes the sensor cells, a plurality of sensor values for each sensor cell is determined in fast succession. The resulting image resolution therefore depends on the number of sensor cells in a sensor array, the travelling speed of the banknotes and the time interval between two successive sensor value readings.

To determine the position and the angle of a banknote before the double feed detection is carried out has the advantage that the imaging, that is the activation of the sensor cells, can be started and stopped exactly when the banknote passes the sensor cells. It further enables to scan only those areas of the transport path that actually are covered by the banknote, in case the banknote is smaller than the width of the transport path or it is skewed with respect to the transport path.

It is self-evident that these advantages could also be achieved by omitting the positioning analysis step and mechanically positioning the banknotes very precisely with respect to the transport path. But it would be mechanically demanding and, since such a precise positioning would require some time, it would undesirably lower the overall processing speed.

One single and strong light source may be utilised to illuminate the banknotes. But, in order to achieve an even light distribution on the banknotes, a multitude of small light sources such as for example light emitting diodes or light guides are used. In a preferred embodiment, the apparatus includes two illumination units each comprising a multitude of light sources arranged in line, thereby forming a first elongated illumination unit for illumination of a first surface of the banknotes and a second elongated illumination unit for illumination of a second surface of the banknotes.

While radiation with a wide range of wavelengths could be used to illuminate the banknotes, the usage of infra-red light is advantageous, because the majority of coloured inks that are used for printing banknotes and other securities appear mostly transparent in the infra-red domain. Hence, printings on banknotes do not or only minimally disturb the double note detection by falsifying the radiation intensity measurements. Particularly preferred is radiation in the near infra-red domain, that is radiation with a wavelength between 700 nm (nano meter) and 1300 nm.

The sensor cells preferably are arranged such that they form a transmission-type sensor for measuring the light transmitted through the banknote and a reflection-type sensor for measuring the light reflected from the banknote.

The elongated illumination units as well as the sensor arrays are arranged on the transport path with their longitudinal axes perpendicular to the moving direction such that the light sources as well as the sensor cells are distributed over the whole width of the transport path.

Each sensor cell for measuring light intensity not only comprises a light sensitive device such as for example a photodiode or a COD (charge coupled device), but also optical means for directing and/or focussing the transmitted or reflected light onto the light sensitive device. The optical means can comprise any kind of lenses. The usage of rod lenses arranged as a rod lens array is preferred because of the compact designs that can be realised with them and because they are rather inexpensive compared with conventional lenses. The usage of such rod lens arrays is well known in the art of 1:1 imaging.

Although the transmission and the reflection images may be captured with two different sensor arrays, it is preferred that only one sensor array is provided. That is one array of sensor cells forms the transmission-type sensor as well as the reflection-type sensor. In this case, the double feed detector further comprises a controller for controlling the illumination units such that they are switched on and off alternately. Hence, the single sensor array measures the intensities of light transmitted through or reflected from the banknotes also in an alternating manner. The controller therefore may be designed to additionally control the sensor array or the storing of the measured values in a memory respectively.

Generally, it would be possible to evaluate the entire transmission and reflection images to 5 detect a double feed. However, this would have drawbacks. On the one hand, it would require a considerable amount of computing and on the other hand, some regions of the banknote that are not particularly suited for doubles detection, would be taken into account. Such regions for example include dark prints, foils (e.g. holograms) and threads or damages of the banknote. Hence, the detection accuracy can be further improved by determining a set of dedicated test spots for the currently processed banknote and deciding on double feed by solely taking these test spots into account.

The test spots could be chosen randomly or according to a given rule like for example: the test spots are chosen as the intersection points of the grid lines of a regular grid laid over the banknote. Still some of these test spots would not be particularly well suited for doubles detection.

A preferred way of determining these test spots is image processing of the transmission and the reflection image with the goal to choose the test spots such that the transmission and reflection intensities measured for these spots are meaningful regarding a double feed decision. Meaningful test spots are chosen by taking into account the position and the angle of the banknote with respect to the transport path as well as the type of banknote that is to be tested. The meaning of the latter means that certain known parameters of the type of the banknote, such as for example the distribution of prints or other features such as holograms or metal stripes on the banknote, the material of which it is made of, the note's size or other properties of the note are considered when the test spots are determined by image processing.

The test spots are particularly positioned such that they are located outside of a banknote area that is not well suited for doubles detection. Such an area is designated herein as an exclusion area. The exclusion area includes for example areas of the banknote with a dark print, foils (e.g. holograms) or threads (e.g. metallic threads). Even though the ink may appear mostly transparent for the utilised light it can falsify the measurements. The exclusion area may further include an area within a given maximum distance to an edge of the banknote because these areas may be mechanically damaged. To take dog-ears into account, the exclusion area additionally may include a particularly shaped area in each corner of the banknote such as for example a triangular, rectangular or square area or it could even be a sector-like area with the center of the circle in the corners of the banknote. This particular choice of the test spots has the advantage, that the intensity measurements in the banknote areas outside of the exclusion areas are mainly attributed to the structure of the paper, in particular the thickness of the paper, which is exactly what is needed to detect a double feed. The basic principle of double detection is the detection of an abrupt change of the light intensities, particularly the transmission intensity.

In order to take account of smaller banknotes, the test spots are, in a preferred embodiment of the invention, partitioned into overlapping regions of the banknote, e.g. five regions, one at the top, bottom, left and right respectively and a central region that overlaps the other four regions.

To decide on double feed in such cases, first an independent double feed detection result is determined for each region separately and independently of each other region. Then, in a second step, an overall double feed detection result is determined by combining the independent double feed detection results of each region in a suitable way. One way would be to decide on double feed for a particular banknote, if it has been decided on double feed for at least one region (or a minimum number of regions) of this banknote. This method corresponds to a kind of OR-combination of the independent detection results. Another way would be to implement some kind of AND-combination including for example a suitable weighting of the independent detection results.

Applying such a method enables to detect a complete as well as a partial overlap. In the case of a partial overlap of two or more banknotes, the decision on double notes can further be backed up by a boundary analysis.

To obtain the information regarding the banknote type for a specific banknote to be tested, several possibilities exist: for example to manually set the type when a certain note is fed into the processing apparatus, to feed only a certain type of banknote into the apparatus or to provide the apparatus with a stacker for each type of banknote, where the apparatus can choose a particular stack thereby "knowing" which type of banknote is deposited in that stacker.

These methods require an additional expenditure of sorting work, when the apparatus should be capable of processing more than one type of banknotes. Therefore, in a preferred embodiment of the invention the type of the banknote to be tested is determined, that is identified, automatically during a validation step, that is carried out before the double feed detection is carried out. Moreover, the double feed detection is only carried out if the banknote has correctly been validated previously.

The validation step is carried out with a validator that is arranged too on the transport path of the apparatus. Since the double feed detection is only carried out, if the banknote could have been validated correctly, the validator and the detector are built such that the banknote validation is carried out before the double note detection. For this purpose, the apparatus could be built such that the detector is arranged on the transport path after the validator with respect to said moving direction. In this case, the validator would have to include separate sensor means for sensing certain banknote characteristics in order to validate the banknote. In another preferred embodiment of the invention, the validator utilises the light intensity measurements of the doubles detection means to validate the banknotes, that is the validator uses the transmission and the reflection images captured with the transmission-type sensor and the reflection-type sensor.

The validation step primarily includes an identification of the banknote. Though, additionally to the identification of the banknote type, the validation step can also comprise an authentication of the banknote. Nevertheless, an authentication of the banknote can also be carried out independently of the banknote identification at any later stage, i.e. between identification and doubles detection, parallel to the doubles detection or even after the doubles detection.

Other advantageous embodiments and combinations of features come out from the detailed description below and the totality of the claims.

Figure 2:
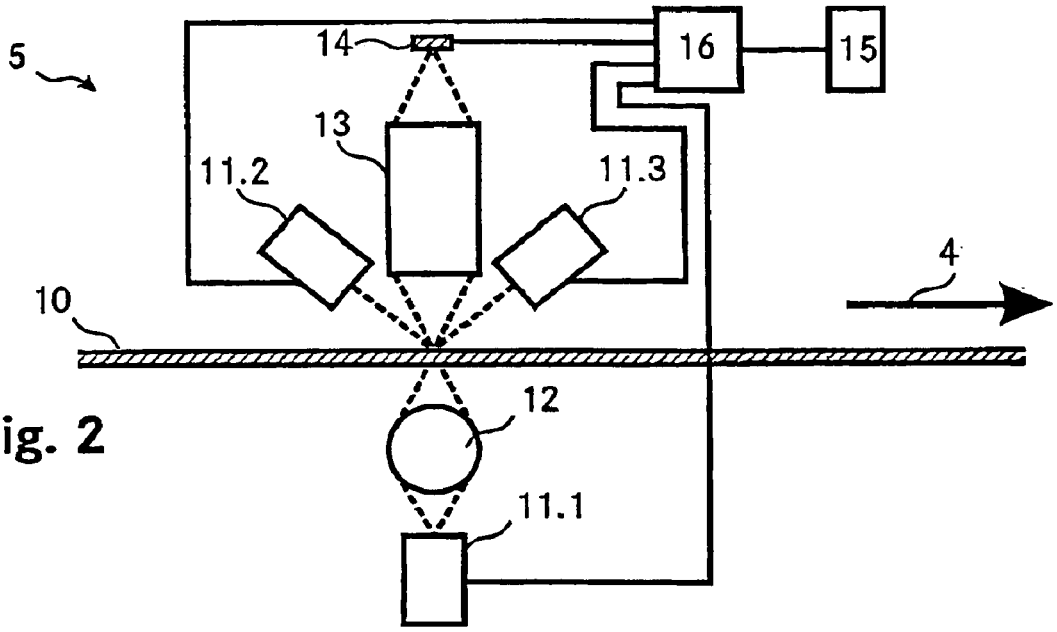
Figure 3:
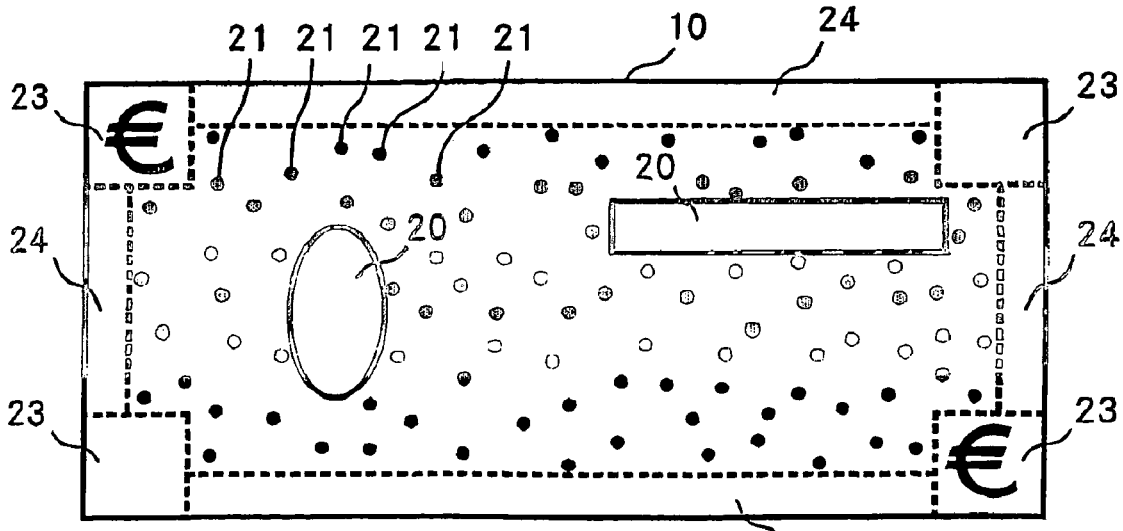
Figure 4:
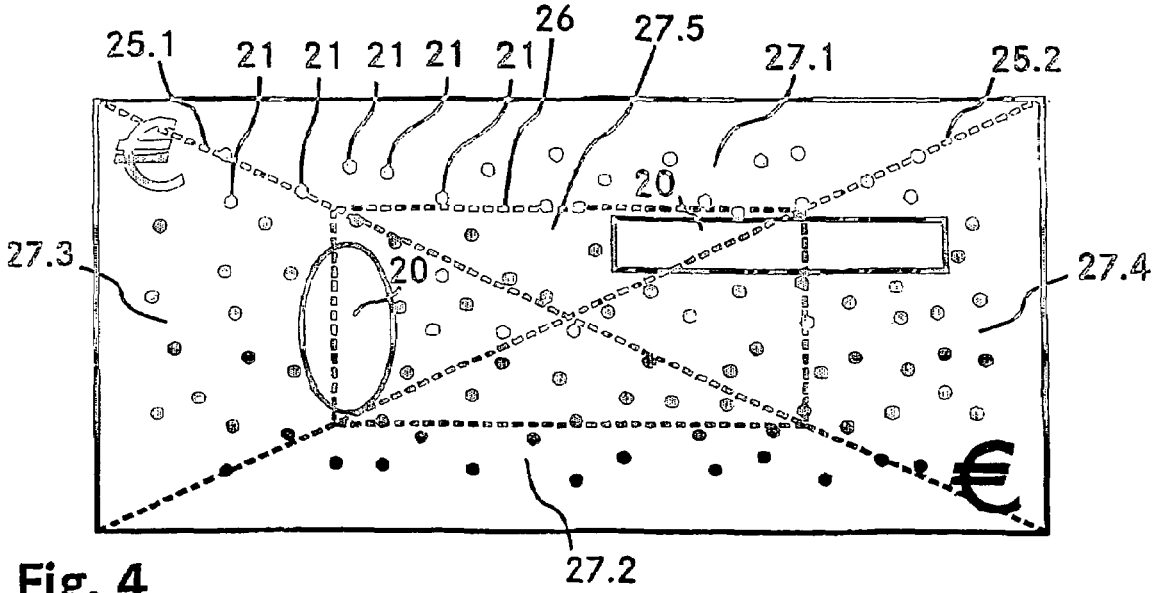
Figure 5:
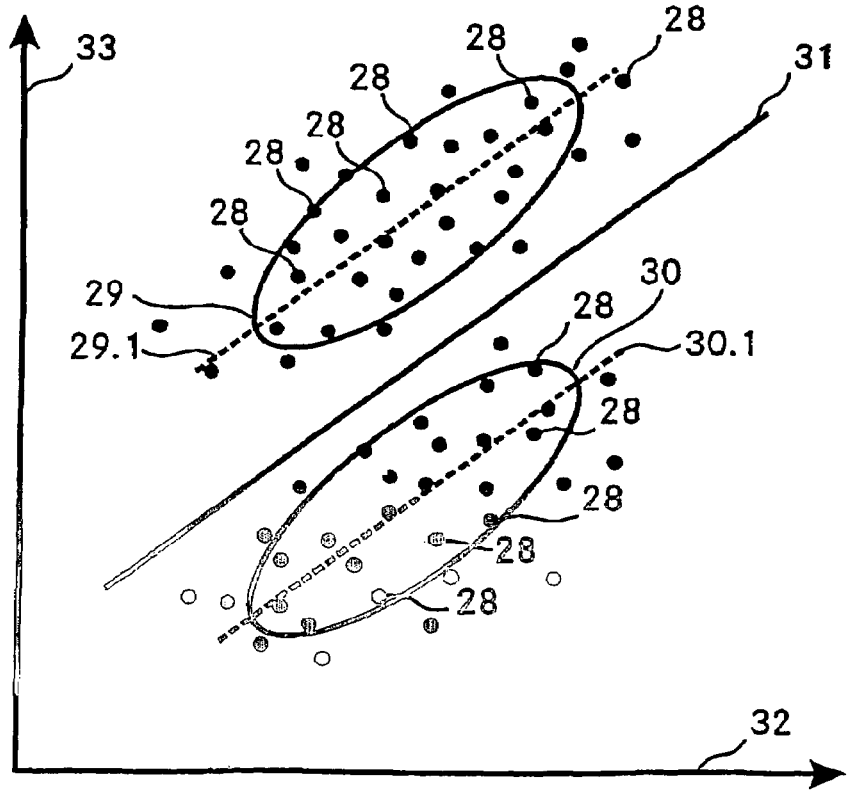
Figure 6:
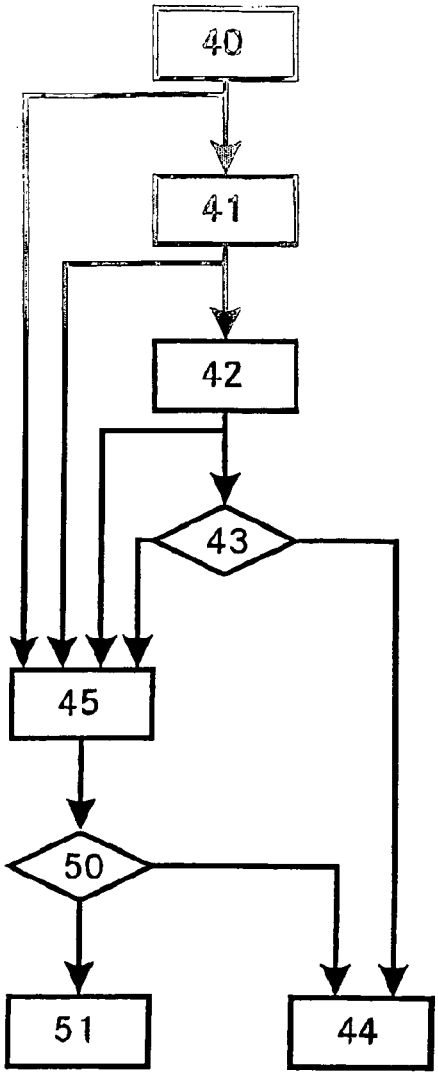
Figure 7:
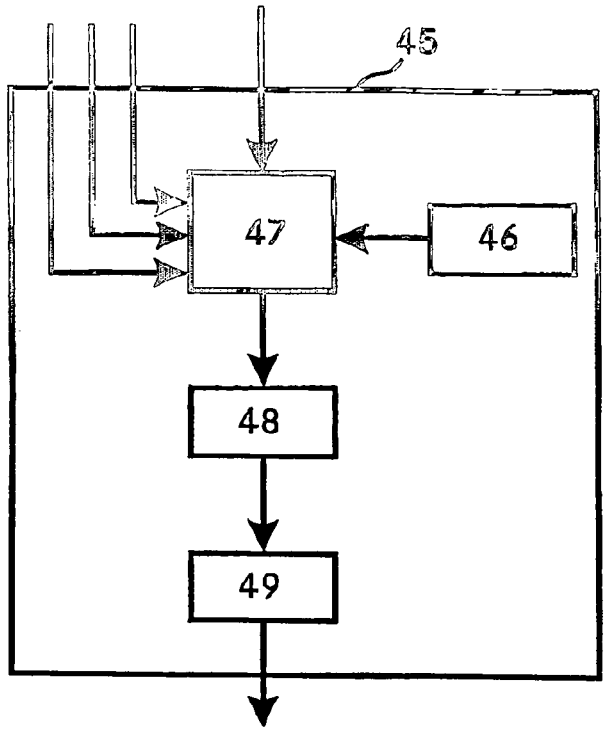

The drawings used to explain the embodiments show:

FIG. 1 An apparatus for processing banknotes according to the invention;

FIG. 2 a schematic diagram of the detection means including illumination;

FIG. 3 a banknote on which a set of test spots is indicated on the basis of which the double note detection is carried out;

FIG. 4 an example of a grouping of the set of test spots into several, overlapping groups;

FIG. 5 a schematic plot of a two-dimensional evaluation chart with a plurality of intensity measurements showing a two-dimensional decision boundary for deciding on double feed;

FIG. 6 a flow chart showing the method of detecting a double feed in the apparatus shown in FIG. 1 and FIG. 7 a flow chart showing the double feed detection steps of FIG. 6 in more detail.

In the Figures, the same components are given the same reference symbols.

In FIG. 1, an apparatus 1 for processing banknotes is shown. The apparatus 1 comprises transport means 2, schematically represented by two Rollers, for conveying the banknotes along the transport path 3 in the moving direction 4. A banknote that is conveyed along the transport path 3 passes an imaging sensor 5 which captures two images of the passing banknote: the first image is produced by sensing light that is transmitted through the banknote and the second image is produced by sensing light that is reflected from the banknote.

Based on these images, a validator 6 attempts to identify and/or authenticate the bank 10 note. If the banknote has not correctly been validated, the banknote is rejected which is for example done by diverting it onto the rejection path 3.1 by means of a switchgear 8. If the banknote has correctly been validated, the detector 7 decides, whether a double feed, where two or more banknotes overlap partially or completely while being conveyed along the transport path 3, exists or not. The doubles detection again is based on the output of the imaging sensor 5, that is by evaluating the transmission and the reflection images. If the detector 7 decides, that there does not exist a double feed, the banknote is accepted and the switchgear 8 directs the banknote onto the default path 3.2 for further processing (not shown). If the detector 7 decides, that a double feed exists, the banknote is rejected and diverted either onto the rejection path 3.1 or onto any other alternative path different from the default path 3.2 and the rejection path 3.1.

Although not shown, the apparatus 1 may include further means, e.g. further sensor means such as for example capacitive or magnetic sensors for sensing additional characteristics of the banknotes.

FIG. 2 shows a banknote 10 which is conveyed along the transport path in the moving 25 direction 4 thereby passing the imaging sensor 5. While the imaging sensor 5 and the banknote 10 are shown in a side view, only one sensor element is shown. However, the imaging sensor 5 includes a plurality of sensor elements such as that shown in FIG. 2, arranged in line, so as to form a sensor array parallel to the surface of the banknote 10 and perpendicular to the moving direction 4.

The imaging sensor 5 comprises a light source 11.1, arranged below and emitting light in the direction of the lower surface 10.1 of the banknote 10. To achieve the goal that the narrow stripe of the banknote 10 that is currently scanned is illuminated as uniformly as possible, a lens 12 for defocusing the light emitted from the light source 11.1 is positioned between the light source 11.1 and the banknote 10. On the upper surface of the banknote 10, the light from the light source 11.1 that has traversed the banknote 10 is passed through the lens 13 and directed onto the light sensor 14. The light sensor 14 includes for example a phototransistor or a CCD device. All of the light sensors 14 of the imaging sensor 5 form a sensor array with a resolution in the range of about 1 to 20 pixels per mm. However, a resolution of about 5 to 10 pixels per mm is preferred.

The lens 13 is for example a rod lens. The rod lenses of all the sensor elements of the imaging sensor are aligned thereby forming a rod lens array which enables a simple way to capture a 1:1 transmission image of the banknote 10. The number of rod lenses is in the range of some dozens to several hundreds. It is to note that the number of light sensors 14 does not have to be the same as the number of rod lenses 13. It is further to note that, since additional optical means such as the lens 12 are used to achieve a highly uniform illumination of the banknote, the number of light sources 11 is typically much lower than the number of rod lenses 13 and light sensors 14.

The sensor element shown in FIG. 2 further comprises two light sources 11.2, 11.3 which are arranged above the upper surface 10.2 of the banknote 10 on either side of the lens 13. They emit light onto the upper surface 10.2 of the banknote in an angle of about 45 degrees. Some of the light that is reflected by the upper surface 10.2 of the banknote passes the lens 13 and produces a continuous reflection image of the upper surface 10.2 of the banknote 10 on the array of light sensors 14.

To distinguish between transmission and reflection measurements, the light sources 11.1, 11.2, 11.3 are operated in multiplex mode, that is the light source 11.1 is switched on and off rapidly in alternation with the light sources 11.2 and 11.3, which are switched on and off at the same time. To ensure that the transmissive and the reflective sampling points represent corresponding portions of the document, the switching frequency must be high relative to the light sensor array resolution as well as relative to the transport speed of the banknote in the moving direction 4. Additionally, the apparatus comprises storing means for storing the multitude of measured light intensity values for each scanned, narrow banknote stripe. The intensity values are measured with the light sensors 14 and are represented by a voltage; a current, a charge or any other electrical measures, are read out with suitable means and then stored in the storing means 15. With a resolution of about 8 pixels per mm, the number of intensity measurements per image for a 130 mm by 70 mm banknote is about 600,000.

To control the switching of the light sources and the correct timing for storing the transmission and the reflection intensities respectively, the detector 6 further includes a controller 16 connected to the light sources 11.1, 11.2, 11.3 and the light sensors 14. The controller 16 may also be used for additional purposes.

Although the imaging sensor 5 is shown to form a mechanical unit, the capturing of the images may also be accomplished with two different light sensor arrays which are arranged at different locations of the transport path. Since the position and the angle of the banknote is determined first, the separately produced transmission and reflection images can be combined so that they correspond properly.

In FIG. 3, a banknote 10 is shown. Several prints on the banknote 10 are shown, for example a currency sign in two corners, an elliptic and a rectangular area with a dark print 20. The banknote may further include other features like thin metal stripes, holograms or any other known features, particularly security features of banknotes.

While hundreds of thousands intensities are measured to produce an image of the banknote, only a small part of these measurements are used to detect double notes. The areas of the banknote 10 that are used for doubles detection, are shown as a multitude of test spots 21 in FIG. 3. The number of test spots 21 is in the range of about 20 up to 1000, depending on the requirements regarding evaluation time and accuracy. Each of these test spots 21 can comprise one or more pixels of the transmission or reflection image respectively and the test spots 21 are more or less evenly distributed over the whole banknote. However, no test spots 21 are positioned within the so-called exclusion areas. These exclusion areas include the dark prints 20, a square area 23 in each corner of the banknote 10 and a rectangular area 24 along the edges of the banknote 10. These areas are excluded from consideration for double note detection, because the probability that the exclusion areas falsify the double note detection is higher than for other areas of the banknote 10. Dark prints 20 may falsify the detection result by lowering the intensity measurements and the square areas 23 as well as the rectangular areas 24 may falsify the detection result because of physical defects of the banknote 10 which typically appear in these areas with a higher probability than in other areas of a banknote.

FIG. 4 again shows the banknote 10 with the test spots 21. In order to group the test spots 21 in different regions which are evaluated separately, two separating lines 25.1, 25.2 and a separating rectangle 26 are shown. The test spots 21 are grouped into five overlapping regions by the separating lines 25.1, 25.2 and the separating rectangle 26. The regions comprise a top region 27.1, a bottom region 27.2, a left region 27.3, a right region 27.4 and a center region 27.5. The regions 27.1-27.5 partially overlap which means that some of the test spots 21 belong to more than one region 27.1-27.5.

As mentioned before, the evaluation of the transmission and the reflection image in order to detect double notes is done with the light intensities measured for the test spots 21 as shown in FIGS. 3 and 4. That is, for each test spot 21, the transmission intensity is drawn against the reflection intensity, leading to an intensity spot 28 for each test spot 21. Doing this for a plurality of single and double banknotes with different degrees of soiling, results in an intensity spot distribution similar to the one shown in the graph of FIG. 5 with the horizontal axis 32 representing the reflection intensity and the vertical axis 33 representing the transmission intensity of the test spots 21. Measurements have shown, that the intensity spots 28 form two clusters, a cluster 29 with the intensity spots for single notes and a cluster 30 with the intensity spots for double notes. The clusters 29,30 have an elongated shape with a longitudinal axis 29.1, 30.1 respectively. The clusters 29,30 are approximately separable by a linear decision boundary 31 which is a simple line drawn between the two clusters. The decision boundary 31 is approximately parallel to the longitudinal axes 29.1, 30.1 of the clusters 29,30.

This particular orientation of the clusters 29,30 and the decision boundary 31 results from the fact that a higher degree of soiling lowers not only the transmission intensity for a certain test spot 21, but also the reflection intensity for this test spot 21 is lowered.

In order to decide whether a double feed exists, the transmission intensities and the reflection intensities for the defined set of test spots have to be measured and a graph similarly to the one shown in FIG. 5 has to be drawn separately for each region of the banknote. Then an independent double feed detection result for each region is determined. If all or most of the intensity spots 28 of a specific banknote region are located above the decision boundary 31, it is decided that no double feed exists for this region. If it is located below the decision boundary 31, it is decided that this region represents a double feed.

The independent double feed detection results for each region then are combined in a suitable way to determine an overall double feed detection result.

It is to note that the evaluation of the measured intensities is performed by a processor, for example a microprocessor. The controller 16 could for example be used to perform this evaluation.

The flowchart of FIGS. 6 and 7 show the method of detecting a double feed in the apparatus of FIG. 1. First, the image capturing 40 of the transmission and the reflection images is carried out. Then, a banknote registration 41 is performed, where the spatial orientation of the banknote, that is the position and the angle of the banknote with respect to the transport path, is determined. In a third step follows the validation 42 of the banknote. If the validation result 43 is negative, that is the banknote has not correctly been validated, the banknote is rejected 44. If the validation result 43 is positive, the double note detection 45 is performed by evaluating the transmission and the reflection images as explained above, considering the results of the image capturing 40, the registration 41 and the validation 42 of the banknote under test. This evaluation comprises the test spot extraction 47 for each region, where specific parameters 46 of the type of the specific banknote, which is determined during the validation 42 step, are taken into account. Then, the region-wise classification 48 follows resulting in a vector of region decisions 49. Each region decision can be accompanied by a confidence value representing how trustworthy this particular region decision is.

Eventually, the overall double note detection result 50 is determined. If the confidence for non double feed is high enough, which means that no double feed has been detected, the banknote is accepted and a further processing 51 can follow. If the confidence for singularity of the banknote is not high enough, which means that it has been decided on double feed, the banknote is rejected 44.

In summary, it is to be noted that, since the number of over-critical as well as under-critical decisions can be reduced, the invention enables a highly robust detection of double feeds in an apparatus for processing sheet-like objects such as banknotes or other securities.

The invention claimed is:

1. A method for optically detecting a double feed in an apparatus for processing one or more types of sheet-like objects, the method comprising:

illuminating the sheet-like objects, measuring transmission intensities of light transmitted through sampling points of a specific sheet-like object of the sheet-like objects;

measuring reflection intensities of light reflected from the sampling points of the specific sheet-like object;

producing a transmission image of the specific sheet-like object from the measured transmission intensities;

producing a reflection image from the measured reflection intensities applying a two-dimensional evaluation method to detect the double feed, the two-dimensional evaluation method being performed by a processor and comprising:

forming a first dimension from the measured transmission intensities;

forming a second dimension from the measured reflection, intensities;

determining locations of the sampling points in the first and second dimensions; and comparing the locations with a linear decision boundary.

2. The method as claimed in claim 1, further comprising:

sequentially feeding the sheet-like objects into the apparatus;

conveying the sheet-like objects along a transport path in a moving direction;

determining a position and an angle of a specific sheet-like object with respect to the transport path, wherein the specific sheet-like object passes a multitude of sensor cells arranged in at least one line being perpendicular to the moving direction, the transmission intensities and the reflection intensities being measured by determining a multitude of sensor values for each sensor cell in fast succession as the specific sheet-like object passes the sensor cells.

3. The method as claimed in claim 2, wherein the sheet-like objects are illuminated with infra-red light.

4. The method as claimed in claim 2, further comprising:

determining test spots for the specific sheet-like object, wherein the two-dimensional evaluation for the specific sheet-like object is carried out for only the test spots.

5. The method as claimed in claim 4, wherein the test spots are defined by applying image processing to the transmission image and the reflection image, based on a position, an angle and known parameters of an object type of the specific sheet-like object.

6. The method as claimed in claim 5, wherein the test spots are positioned outside of an exclusion area of the specific sheet-like object, the exclusion area comprising at least one of the following object areas:

a) an area of the specific sheet-like object having at least one of a dark print, a foil, a hologram and a thread, b) an area within a given maximum distance from an edge of the specific sheet-like object, and c) an area in each corner of the specific sheet-like object.

7. The method as claimed in claim 4, wherein the test spots are grouped in a plurality of overlapping regions of the specific sheet-like object, the method further comprising:

determining an independent double feed detection result for each region of the plurality of overlapping regions; and determining an overall double feed detection result by combining the independent double feed detection result of each region.

8. The method as claimed in claim 5, further comprising:

determining an object type of the specific sheet-like object; and validating the specific sheet-like object, wherein the two-dimensional evaluation method to detect the double feed is only applied if the specific sheet-like object is validated.

9. An apparatus for processing one or more types of sheet-like objects, comprising:

a transport path;

a transporter that conveys the sheet-like objects along the transport path in a moving direction;

a detector that optically detects a double feed of the objects, the detector comprising:

an illuminator that illuminates the sheet-like objects;

a transmission-type sensor that measures the transmission intensities of light transmitted through the sampling points of the sheet-like objects;

a reflection-type sensor that measures the reflection intensities of light reflected from the sampling points of the sheet-like objects; and an evaluator that performs a two-dimensional evaluation by forming a first dimension from the transmission intensities and a second dimension from the reflection intensities, determining locations of the sampling points in the first and second dimensions, and comparing the locations with a linear decision boundary.

10. The apparatus as claimed in claim 9, the illuminator comprising:

a first elongated illumination unit for illumination of a first surface of the sheet-like objects; and a second elongated illumination unit for illumination of a second surface of the sheet-like objects.

11. The apparatus as claimed in claim 10, wherein the transmission-type sensor comprises an array of sensor cell, the reflection-type sensor comprises an array of sensor cells, and the elongated illumination units and the arrays of sensor cells are arranged perpendicular to the moving direction of the transport path.

12. The apparatus as claimed in claim 11, wherein each sensor cell comprises a light sensitive device that measures the intensities of light, the detector further comprising:

an optical device, that directs the transmitted or reflected light onto the light sensitive device.

13. Apparatus as claimed in claim 11, the detector further comprising:

a controller that alternately switches the illumination units on and off and alternately measures the intensities of light transmitted through or reflected from the sheet-like objects, wherein exactly one array of sensor cells forms the transmission-type sensor and the reflection-type sensor.

14. The apparatus as claimed in claim 10, further comprising:

a validator that determines the validity of the sheet-like objects, wherein the validator determines the validity of the sheet-like objects before the detector optically detects a double feed and the detector optically detects a double feed only if the validator validates the sheet-like objects.

15. The method as claimed in claim 1, wherein the sheet-like objects are banknotes.

16. The apparatus as claimed in claim 9, wherein the sheet-like objects are banknotes.

17. The method as claimed in claim 6, wherein the area in each corner of the specific sheet-like object is substantially rectangular.

18. The apparatus as claimed in claim 10, wherein each of the first and second elongated illumination units comprises a multitude of light sources arranged in a line.

19. The apparatus as claimed in claim 12, wherein the optical device is a rod lens.

* * * * *